United States Patent [19]

Klem

[11] Patent Number: 4,522,144

[45] Date of Patent: Jun. 11, 1985

[54] LIFE SAVING SYSTEM FOR MARINE STRUCTURE

[75] Inventor: Per G. Klem, Jar, Norway

[73] Assignee: Harding A/S, Rosendal, Norway

[21] Appl. No.: 605,993

[22] Filed: May 2, 1984

Related U.S. Application Data

[63] Continuation of Ser. No. 388,736, Jun. 15, 1982, abandoned.

[30] Foreign Application Priority Data

Jun. 30, 1981 [NO] Norway ..... 812231

[51] Int. Cl.[3] ..... B63C 9/06

[52] U.S. Cl. ..... 114/348; 114/365; 114/378

[58] Field of Search ..... 114/348, 365–379, 114/380; 405/1, 2

[56] References Cited

U.S. PATENT DOCUMENTS

| | | | |
|---|---|---|---|
| 2,350,344 | 6/1944 | Fraser et al. | 114/375 |
| 2,714,731 | 8/1955 | Binmore | 114/378 |
| 3,137,013 | 6/1964 | Devonport | 114/369 |
| 3,747,137 | 7/1973 | Simpson | 114/368 |

FOREIGN PATENT DOCUMENTS

| | | | |
|---|---|---|---|
| 143839 | 4/1981 | Norway . | |
| 1200709 | 7/1970 | United Kingdom | 114/315 |

OTHER PUBLICATIONS

"A New Dimension in Life Saving at Sea—A Systematic Approach to a New Abandonment System" Larsen, Norwegian Merit Research, 1/1979, pp. 27–39.

*Primary Examiner*—Trygve M. Blix
*Assistant Examiner*—Stephen P. Avila
*Attorney, Agent, or Firm*—Wenderoth, Lind & Ponack

[57] ABSTRACT

A rescue system for a marine structure such as an offshore drilling rig or production platform includes an enclosed type life boat constructed to be supported on board the marine structure by being releasably suspended over free water from a single point or fulcrum. The fulcrum is located relative to the center of gravity of the life boat such that the latter, in its suspended position, adopts a predetermined slanting orientation which it maintains substantially constant throughout its free fall when released from its suspension.

5 Claims, 2 Drawing Figures

LIFE SAVING SYSTEM FOR MARINE STRUCTURE

This application is a continuation of now abandoned application Ser. No. 388,736, filed 06/15/82.

BACKGROUND OF THE INVENTION

The present invention relates to a life-saving or rescue system for a marine structure, and it is particularly intended for use in connection with offshore structures such as drilling rigs, production plattforms and the like.

Conventional rescue systems used on ships are based on life boats supported in davits by means of which they are swung free of the ship's side and lowered into the water. Davits are rather complicated apparatus requiring frequent inspection and testing to keep the risk of malfunction at a reasonably low level. The launching operation, including boarding, swinging and lowering the life boat, requires a relatively long time, and in cases of rough sea there is always the risk of the life boat being crushed against the ship side during lowering or after release.

Recently a simpler and safer rescue system has been developed in which the life boat, which is of the enclosed type, from a horizontal storing and boarding position on board the ship, is allowed to slide down a ramp and fall freely therefrom to plunge into the water bow foremost and with its longitudinal axis extending in a preferred angle of impact. The drop energy of the boat will then be converted into positive propulsion of the boat in a direction away from the ship.

When using the above described rescue system the angle of impact of the life boat relative to the water surface, in addition to the height of the drop, will determine the acceleration loads at the moment of impact, as well as the subsequent propulsion. If the angle of impact is too steep the boat will rebound, and if the angle is too small the shock forces on hull and passengers will be excessive for drops above a certain limit. Therefore, if the rescue system is to function properly, the angle of impact when launching the life boat must be within specified limits. The angle of impact in turn depends on the launching angle, i.e. the degree of incline of the ramp initiating the boat's motion at the time of launching. When leaving the ramp upon launching a rotary torque will be applied to the boat resulting in a constant fore- and -aft rotation of the freely falling boat. Consequently it will be necessary in each case to calculate the adequate ramp incline for different heights of fall, and the uncertainty factor associated with the angle of impact increases with the height through which the boat will be falling. Any list and/or trim of the structure carrying the life boat will further influence the angle of launch and consequently the angle of impact when launching a life boat according to the above method. Use of this system is presently approved only for drops up to about 20 meters, which means that its application is mainly limited to ships and semisubmersibles at operational draft.

However, also offshore structures such as production platforms etc., are in demand of a life saving or rescue system having a simpler construction and quicker operation than conventional implements now in use. In this case, however, the drop height may be excessive so that the above mentioned system cannot be used due to the uncertainty as to the angle of impact. Thus, an object of the present invention is to provide a rescue system based on an enclosed life boat constructed to perform a free fall when launched, in which the impact angle of the boat with the water surface is substantially independent of its height of fall and of any list of the marine structure carrying it.

SUMMARY OF THE INVENTION

According to the invention this object is achieved by releasably suspending the life boat from the marine structure at a single fulcrum located above and aft of the center of gravity of the life boat, on a line through the center of gravity making an angle with the longitudinal axis of the boat substantially equal to the complementary angle of the preferred angle of impact. When suspended in a such manner the life boat will adopt an inclined position with its longitudinal axis at an angle to the horizontal corresponding to the preferred angle of impact, and when the boat suspending means is released the boat will maintain its inclined position throughout its free fall, since no torque is applied to it at the moment of release.

Thus, by suspending the boat inclined at an angle corresponding to the optimum preferred angle of impact the boat will reach the water at an angle equal or approximate to this optimum angle of impact, and in any case certainly within the tolerance limits described for this angle. Therefore the rescue system according to the invention may be applied for falls substantially higher than the maximum allowable height for the above described, prior system, and thus also for offshore structures of all kinds.

BRIEF DESCRIPTION OF THE DRAWINGS

A non-limiting embodiment of the invention will be described below with reference to the accompanying drawings, in which.

DETAILED DESCRIPTION OF THE INVENTION

Figures 1, 2:
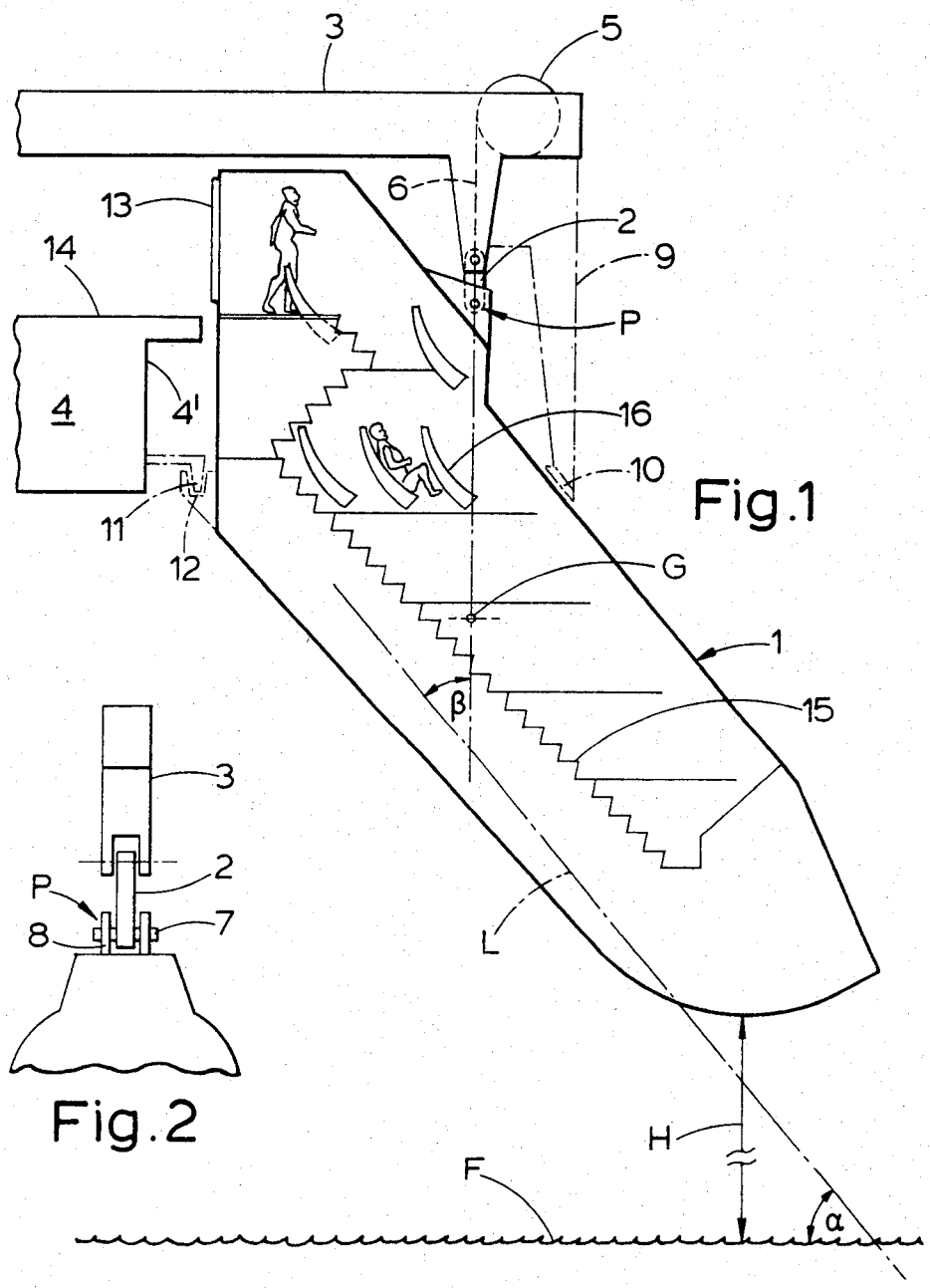
FIG. 1 is an elevational view showing a life boat suspended according to the novel aspect of the rescue system according to the invention.
FIG. 2 is a front view of the suspension arrangement.

Referring to the drawing numeral 1 is an enclosed type life boat constructed in a manner to undergo a free fall H when launched and to take the water bow foremost and with its longitudinal axis L in a preferred angle of impact $\alpha$ relative to the water surface F.

The life boat 1 is suspended from a releasable hook means 2 supported by a cantilever 3 on a marine structure such as an offshore drilling rig, indicated at 4 in FIG. 1. The support 3 preferably extends normal to the side 4 of the rig 4, to hold the boat 1 suspended over free water with adequate clearance to the rig side. Indicated in FIG. 1, also is a winch means 5 mounted in support 3 and adapted to be associated with the releasable hook means 2 via a line 6 when the boat is to be repositioned after tests or trials from the water. The winch 5 is merely intended to pull the life boat 1 into its initial storing and boarding position as shown in FIG. 1, and normally it will not be used for launching purposes.

According to the invention the life boat 1 is suspended from the hook means 2 at a single point of suspension or fulcrum P located relative to the center of gravity G of the boat such that the boat 1 automatically adjusts itself into an inclined position with its bow pointing outward and downward and with the longitudinal axis L of the boat at an angle to the horizontal corresponding to the above mentioned preferred angle of impact when the boat is launched. That is, the fulcrum P must be located above and aft of the center of gravity G of the boat 1, and be on a line extending at an angle $\beta$ with the longitudinal axis, angle $\beta$ being equal to the complementary angle of the preferred angle of impact $\alpha$.

In practice the suspension fulcrum P of the boat may take several forms. In FIG. 2 is shown a possible form comprising a strong cross bolt 7 supported in brackets 8 rigidly secure to main structural members (not shown) of the boat 1.

The releasable hook means 2 from which the boat 1 is suspended may be of any conventional type capable of being released in a loaded condition. Such releasable hook means are commercially available and therefore need not be further described herein. The releasing action may be effected by mechanical, electrical or hydraulic actuation, for example from a central panel on board the life boat.

Safe guarding of the boat 1 to prevent swinging motion of the boat thus suspended should be such that it will not interfere with the free vertical fall of the boat and at no point support any part of the weight of the boat which is to be supported only by the hook means 2 through the suspension point or fulcrum P. This may be realized in any convenient manner obvious to a person skilled in the art. In the example shown in the drawing the safe guarding structure comprises a prop arm 9 extending downwardly from the outer end of the support 3 and including a cushion 10 engaging the upper surface of the boat 1, and a dog member 11 extending outwardly and downwardly from the rig side 4' to engage a mating upturned recess 12 at the stern of the boat 1.

In the embodiment of the rescue system according to the invention as shown in the drawings the life boat 1 is conveniently boarded through a hatchway 13 in the stern of the life boat, a specially adapted protruding boarding deck 14 of the rig 4 being contemplated for such boarding purposes.

Internally the life boat 1 is equipped with a step arrangement 15 adjusted to the inclination of the life boat in its suspended position, allowing the persons boarding the boat to take places in specially formed seats 16 which are distributed along the length of the boat (only a few shown in FIG. 1), these seats also being adjusted to the inclination of the boat.

In a case of emergency the life boat 1 of the rescue system according to the present invention is boarded in its suspended inclined position as described above. When the prescribed number of persons are on board and have taken their seats and fastened their seat belts, the hook means 2 is released and the boat 1 will then fall freely through the drop H and meet the water surface F bow foremost. Owing to the fact that the boat, prior to being released, is suspended from a single point P vertically above its centre of gravity G, it will not be subjected to any rotary torque at the moment of release, and consequently it will substantially maintain its original inclination throughout its free fall and take the water with its longitudinal axis L oriented substantially at the preferred angle $\alpha$ to the water surface. The boat will thus plunge slantingly into the water in a manner that dampens the impact loads, and its fall energy will then drive it in a curved motion down through the water away from the rig and up again into a floating horizontal position at a distance from the rig. The passengers may then sit up in normal position in the specially built seats, the propulsion motor may be started and the boat manoeuvred as an ordinary life boat.

The preferred optimum angle of impact $\alpha$ will generally be within 30° and 60°, depending on the dimensions and weight distribution of the life boat, a normal value being about 50°. The angle $\beta$, defining the locus of the fulcrum P, is thus given, in view of the fact that it corresponds to the complementary angle of the optimum angle of impact $\alpha$, as previously explained.

In the embodiment shown the seats 16 are lay-down seats arranged substantially parallel to the longitudinal axis L of the boat, this being assumed to provide the most favourable support for the user during the shock load at the moment of impact. However, the seats may also have a different orientation, for example parallel to the water surface in the boat's inclined position, if that is desirable.

If necessary the support 3 may be combined with a boom to be pivotably supported, to allow the boat 1 to be stored and boarded in a position within the main contours of the marine structure, for example if the latter is a ship. The boom is then swung into its outwardly extending operational position as shown in FIG. 1, after which release of the life boat is effected as explained above. The boat may also rest in a horizontal position during boarding and then be brought into correct inclined position immediately prior to release. However, it is preferred to have the boat stored and boarded in a ready position over free water, since this provides the simplest and functionally safest solution, providing an absolute minimum of wasted time in an emergency situation.

What I claim is:

1. A free fall rescue system for use on a marine structure having a height of up to more than 20 meters, said system comprising:

an enclosed life boat having a bow, a stern, a center of gravity, a single fulcrum located above and aft of said center of gravity and a longitudinal axis;

means for suspending said life boat at said single fulcrum from the marine structure at a height of up to more than 20 meters over free water in an inclined position with said bow directed outwardly from the marine structure and downwardly and with said longitudinal axis extending with respect to the water surface at a first angle of approximately 40°–60° corresponding to a preferred angle of impact of said life boat therewith upon free fall vertically downwardly of said life boat from said inclined position;

said single fulcrum being located at a position on a line extending through said center of gravity and extending with respect to said longitudinal axis in said inclined position at a second angle substantially equal to an angle complementary to said first angle;

said suspending means supporting at said single fulcrum the entire weight of said life boat in said inclined position; and said suspending means being selectively releasable to allow said life boat to fall freely vertically downwardly from said inclined position and to impact bow-first with the free water at said first angle.

2. A system as claimed in claim 1, wherein said suspending means comprises a cantilever extending from the marine structure outwardly over the free water and a releasable hook suspended from said cantilever and operable to suspendingly engage said single fulcrum.

3. A system as claimed in claim 1, further comprising means for preventing said life boat from swinging with respect to the marine stucture when in said inclined position without interference with the free fall of said life boat from said inclined position, said preventing means supporting no part of the weight of said life boat.

4. A system as claimed in claim 3, wherein said preventing means comprises an arm extending from the marine structure and cushioningly engaging the upper surface of said life boat directed away from the marine structure, and a member extending outwardly and downwardly from the marine structure and loosely received in a mating upturned recess in said stern of said life boat.

5. A system as claimed in claim 1, wherein said first angle is approximately 50°.

* * * * *